US006640726B2

(12) United States Patent
Theurer et al.

(10) Patent No.: US 6,640,726 B2
(45) Date of Patent: Nov. 4, 2003

(54) MACHINE FOR REMOVING TIES OF A TRACK

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/224,947

(22) Filed: Aug. 21, 2002

(65) Prior Publication Data

US 2003/0056681 A1 Mar. 27, 2003

(30) Foreign Application Priority Data

Sep. 21, 2001 (AU) ..... 729/2001 U

(51) Int. Cl.[7] ..... E01B 29/00
(52) U.S. Cl. ..... 104/9; 104/2
(58) Field of Search ..... 104/2, 4, 6, 8, 104/9, 12, 7.1

(56) References Cited

U.S. PATENT DOCUMENTS 4,258,626 A * 3/1981 Theurer et al. ..... 104/6
4,643,100 A * 2/1987 Valditerra ..... 104/2
4,809,614 A * 3/1989 Theurer et al. ..... 104/7.2
4,878,435 A 11/1989 Theurer
4,892,040 A 1/1990 Theurer
5,125,345 A * 6/1992 Theurer et al. ..... 104/9
5,357,867 A 10/1994 Theurer
5,651,317 A * 7/1997 Kim ..... 104/9

* cited by examiner

*Primary Examiner*—Mark T. Le
(74) *Attorney, Agent, or Firm*—Henry M. Feiereisen

(57) ABSTRACT

A machine for continuously removing old ties of a railroad track supported on a ballast bed includes a machine frame extending in a longitudinal direction along the track. Undercarriages support the machine frame for mobility in an operating direction. An apparatus for picking up old ties from the ballast bed is mounted on the machine frame, and a conveyor device for transporting away the picked-up old ties in the longitudinal direction is associated with said apparatus. A tie displacement device having a pushing member is positioned ahead of—with regard to the operating direction—the apparatus for picking up old ties. Drives are, provided for adjusting the pushing member vertically and transversely to the longitudinal direction in order to push an old tie laterally out of the track and onto a ballast bed shoulder.

3 Claims, 1 Drawing Sheet

MACHINE FOR REMOVING TIES OF A TRACK

CROSS-REFERENCES TO RELATED APPLICATIONS

This application claims the priority of Austrian utility model application GM 729/2001, filed Sep. 21, 2001, the subject matter of which is incorporated herein by reference.

BACKGROUND OF THE INVENTION

The present invention relates, in general, to a machine for continuously removing old ties of a railroad track supported on a ballast bed, and more particularly to a machine which includes a machine frame extending in a longitudinal direction along the track; undercarriages supporting the machine frame for mobility in an operating direction; an apparatus, mounted on the machine frame, for picking up old ties from the ballast bed; and a conveyor device, cooperating with said apparatus, for transporting away the old ties in the longitudinal direction.

U.S. Pat. No. 5,357,867 discloses a machine of this type, designed for completely renewing a railroad track. While the machine advances continuously, the old ties are lifted from the ballast bed and stored on the machine. Parallel thereto, new ties are laid down on the ballast bed, and lastly new rails are installed on the new ties.

It would be desirable and advantageous to provide an improved machine of the afore-described type, with which it is possible to achieve a steady and uniform operating efficiency even if the quality of the old ties varies.

SUMMARY OF THE INVENTION

According to one aspect of the present invention, a machine for continuously removing old ties of a railroad track supported on a ballast bed includes a machine frame extending in a longitudinal direction along the track; undercarriages supporting the machine frame for mobility in an operating direction; an apparatus, mounted on the machine frame, for picking up old ties from the ballast bed; a conveyor device, cooperating with said apparatus, for transporting away the old ties in the longitudinal direction; and a tie displacement device positioned ahead of—with regard to the operating direction—the apparatus for picking up old ties and including a pushing member and drives for adjusting the pushing member vertically and transversely to the longitudinal direction.

A machine designed in this way ensures that the continuity of the track renewal process is not adversely affected in any way by the presence of even a very brittle or crumbling old tie in the track, since this problem-causing old tie can now be moved very quickly transversely to the longitudinal direction onto the ballast bed shoulder with the aid of the pushing member. Thus, any possible obstruction to the functioning of the trailing apparatus for picking up the normal, unbroken ties can be reliably prevented, such disturbances having the potential of being particularly troublesome because, as a rule, they require the forward motion of the machine to be stopped and tie fragments to be withdrawn by hand.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figures 1, 2, 3, 4:
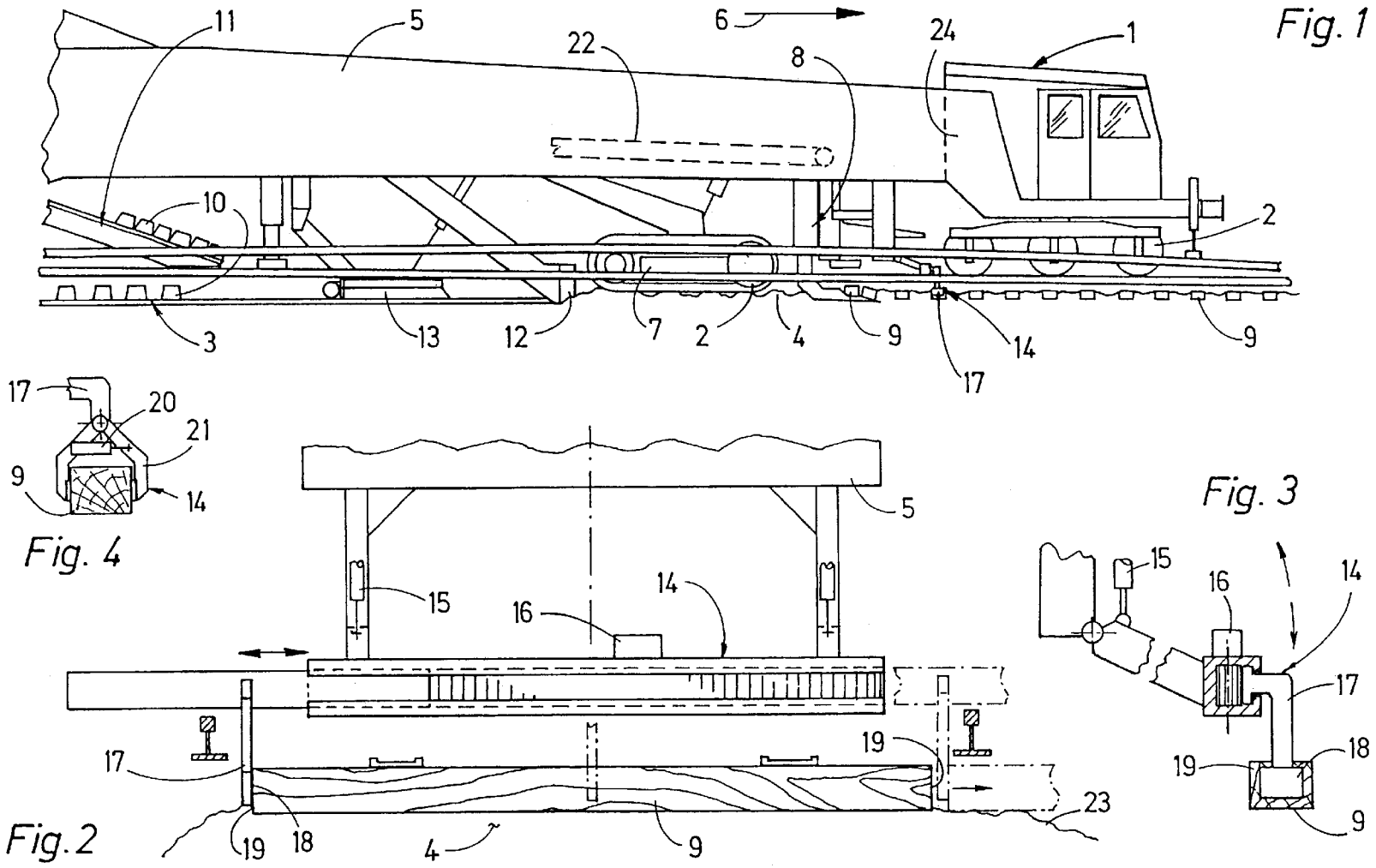
FIG. 1 is a side view of a front end of a machine for renewing a track, including a tie displacement device, in accordance with the present invention.
FIG. 2 is an enlarged detailed view of the tie displacement device, as viewed in a longitudinal direction.
FIG. 3 is an enlarged detailed view of the tie displacement device as viewed in a direction transversely to the longitudinal direction.
FIG. 4 is a schematic illustration of variation of a tie displacement device.

Throughout all the Figures, same or corresponding elements are generally indicated by same reference numerals.

Turning now to the drawing, and in particular to FIG. 1, there is shown a machine 1 designed for renewal of a track 3 comprising old ties 9 resting on a ballast bed 4. The machine 1 includes a machine frame 5, extending in a longitudinal direction, which is mobile by means of undercarriages 2 on the track 3, or on the ballast bed 4, in an operating direction indicated by an arrow 6. The second one of the undercarriages 2 is in the shape of a caterpillar-tracked undercarriage 7. Provided immediately ahead of the latter, with respect to the operating direction, is an apparatus 8 for picking up the old ties 9.

An apparatus 11 serves for laying new ties 10 upon the ballast bed 4. Provided for the purpose of planing the exposed ballast bed 4 are a milling grader 12 and a consolidating device 13 which are vertically adjustably connected to the machine frame 5.

A tie displacement device 14 is arranged preceding—with regard to the operating direction of the machine 1—the apparatus 8 for picking up old ties 9. As can be seen particularly in FIGS. 2 and 3, the tie displacement device 14 is vertically adjustable by means of a drive 15 and is equipped with a pushing member 17 which is adjustable transversely to the longitudinal direction by means of a further drive 16. The pushing member 17 has a contact surface 18, extending in the longitudinal direction and vertically, for application to an end surface 19 of the old tie 9 to be removed.

As shown in FIG. 4, the pushing member 17 may also, for instance, have the shape of a pair of gripping tongs 21 which are squeezable towards one another in the longitudinal direction by means of a drive 20.

In working operations, the machine 1 advances continuously while the old ties 9 are lifted off the ballast bed 4 with the aid of the apparatus 8. In further sequence, the removed old ties 9 are delivered to a conveyor device 22 for storing the old ties 9 on the machine 1.

As soon as an operator, stationed in an operator's cabin 24 of the machine 1, detects the presence of a brittle or damaged old tie 9, the tie displacement device 14 is lowered and the drive 16 is actuated (see FIGS. 2 and 3). As a result of that action, the pushing member 17 is applied to the end surface 19 of the damaged old tie 9 and displaced transversely to the longitudinal direction, together with the old tie, until the latter comes to lie on a ballast bed shoulder 23 (see dash-dotted lines in FIG. 2). Thereafter, the tie displacement device 14 is immediately lifted again into an inoperative position on the machine frame 5.

Due to the swiftness of the removal of the damaged tie, uninterrupted forward travel of the machine 1 is ensured.

Any jamming of the fragments of a fracturing or crumbling old tie 9, which is particularly disadvantageous when occurring inside the apparatus 8, can thus be reliably precluded.

While the invention has been illustrated and described as embodied in a machine for removing ties of a track, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A machine for continuously removing old ties of a railroad track supported on a ballast bed, including a) a machine frame extending in a longitudinal direction along the track;

b) undercarriages supporting the machine frame for mobility in an operating direction;

c) an apparatus, mounted on the machine frame, for picking up old ties from the ballast bed;

d) a conveyor device, cooperating with said apparatus, for transporting away the old ties in the longitudinal direction; and e) a tie displacement device positioned ahead of—with regard to the operating direction—the apparatus for picking up old ties and including 1) a pushing member and 2) drives for adjusting the pushing member vertically and transversely to the longitudinal direction.

2. The machine of claim 1, wherein the pushing member has a contact surface, extending in the longitudinal direction and vertically, for application to an end surface of the old tie to be removed.

3. The machine of claim 1, wherein the pushing member comprises two gripping tongs for engaging the old tie to be removed, and a drive for squeezing the gripping tongs together in the longitudinal direction.

* * * * *